US006309249B1

(12) United States Patent
Didehvar et al.

(10) Patent No.: US 6,309,249 B1
(45) Date of Patent: Oct. 30, 2001

(54) FACEPLATE LIGHT SOCKET ASSEMBLY

(75) Inventors: Kaveh Didehvar, Hockessin, DE (US); William G Carôn, Aston, PA (US)

(73) Assignee: Zenith Products Corp., New Castle, DE (US)

( * ) Notice: Subject to any disclaimer, the term of this patent is extended or adjusted under 35 U.S.C. 154(b) by 0 days.

(21) Appl. No.: 09/240,518

(22) Filed: Jan. 29, 1999

(51) Int. Cl.[7] ..... H01R 35/00
(52) U.S. Cl. ..... 439/536; 439/667; 362/266
(58) Field of Search ..... 439/536, 666, 439/667, 616, 546; 362/266, 341, 310

(56) References Cited

U.S. PATENT DOCUMENTS

| | | | | |
|---|---|---|---|---|
| Re. 20,032 | | 7/1936 | Douglas | 173/339 |
| 1,226,584 | * | 5/1917 | Paiste | 439/666 |
| 1,478,166 | * | 12/1923 | Benjamin | 439/667 |
| 1,764,997 | | 6/1930 | Arras . | |
| 1,876,877 | | 9/1932 | Douglas . | |
| 1,979,968 | | 11/1934 | Geiger et al. | 240/61 |
| 2,012,979 | | 9/1935 | Von Holtz | 173/339 |
| 2,110,134 | | 3/1938 | Douglas | 178/7 |
| 2,992,323 | | 7/1961 | Fletcher | 240/85 |
| 3,511,982 | | 5/1970 | Salter | 240/8.16 |
| 3,604,919 | | 9/1971 | MacPherson | 240/8.16 |
| 3,912,355 | | 10/1975 | Curado et al. | 339/128 |
| 4,468,585 | | 8/1984 | Beyland et al. | 313/318 |
| 4,565,419 | * | 1/1986 | Johnson et al. | 439/666 |
| 4,747,029 | | 5/1988 | Liverance et al. | 362/226 |
| 4,874,904 | * | 10/1989 | DeSanti | 439/536 |
| 4,882,660 | | 11/1989 | Liverance et al. | 362/226 |
| 4,926,301 | | 5/1990 | Liverance et al. | 362/226 |

* cited by examiner

*Primary Examiner*—Hien Vu
(74) *Attorney, Agent, or Firm*—Edgar A. Zarins; Lloyd D. Doigan

(57) ABSTRACT

A faceplate light socket assembly for a light bank of the type used above vanity cabinets. The faceplate socket maintains a light bulb in substantially horizontal orientation perpendicular to the wall to which the light assembly is mounted. A pre-wired socket includes a spring clip which detachably retains the socket within a specially configured aperture of the faceplate. The aperture has an insertion slot to facilitate insertion of the spring within the aperture, a helical edge which gradually reduces the diameter of the aperture and a retaining notch to lock the socket in position. The helical edge biasingly compresses the spring clip upon rotation of the socket to maintain the socket within the aperture. An outer cylindrical surface of the socket is threaded for attaching a decorative sleeve.

14 Claims, 3 Drawing Sheets

FACEPLATE LIGHT SOCKET ASSEMBLY

BACKGROUND OF THE INVENTION

I. Field of the Invention

This invention relates to light sockets for vanity lights and, in particular, to a faceplate configuration receiving a light socket which simplifies assembly of the vanity light set.

II. Description of the Prior Art

Banks of vanity lights have become popular means of illuminating bath areas. A plurality of lights are mounted to a faceplate which encloses an electrical box housing the electrical wiring. The sockets mounted to the faceplate are positioned perpendicular to the plate thereby retaining the light bulb in a horizontal position substantially perpendicular to the bathroom wall. The socket may be mounted to the faceplate in any number of well-known manners. However, such prior known methods are very labor intensive adding considerably to the cost of manufacturing. Additionally, such prior known assemblies may not allow for mounting of a variety of aesthetic faceplates depending upon the desired finish of the assembled light bar.

SUMMARY OF THE PRESENT INVENTION

The present invention overcomes the disadvantages of the prior known light assemblies by providing a socket which is detachably received within the faceplate in a manner which simplifies assembly of the light bar.

The faceplate light socket assembly is intended to form a part of a vanity light bar having a housing to enclose electrical wiring, a faceplate to cover the face of the housing and a light bulb socket which positions a light bulb substantially perpendicular to the faceplate and the bathroom wall. A fascia may also be utilized to alter the decorative appearance of the light bar. The faceplate for the light assembly includes at least one aperture to receive a light bulb socket. The socket preferably has a spring clip adapted to be received by the faceplate aperture to removably maintain the socket within the faceplate. The faceplate aperture has a specific peripheral configuration which includes an enlarged insertion slot, a helical edge which gradually reduces the diameter of the aperture, and a retaining notch to fix the position of the socket. The spring clip is slowly compressed upon rotation of the socket within the aperture thereby maintaining the socket within the aperture of the faceplate. In a preferred embodiment, the exterior cylindrical surface of the socket has threads for attaching a decorative sleeve to conceal the socket. The decorative sleeve may also be used to maintain a fascia against the faceplate such as a mirrored, decorative metal, or wood trim panel.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
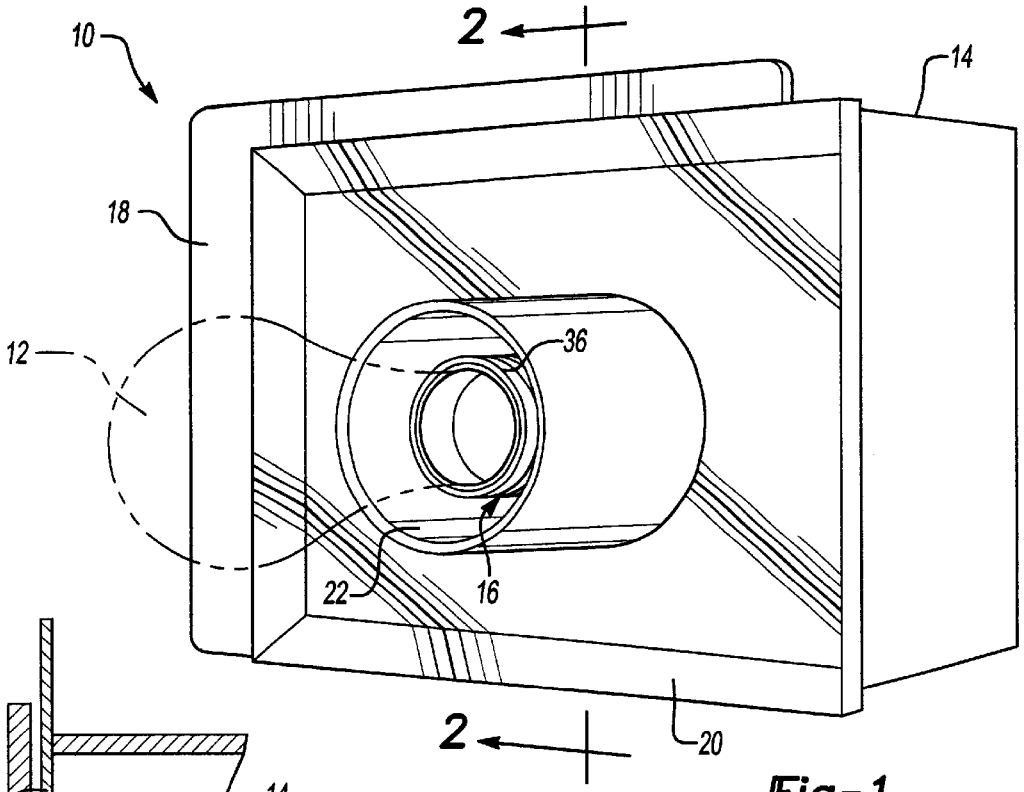
FIG. 1 is a partial perspective view of a light bank embodying the light assembly of the present invention.
Figure 2:
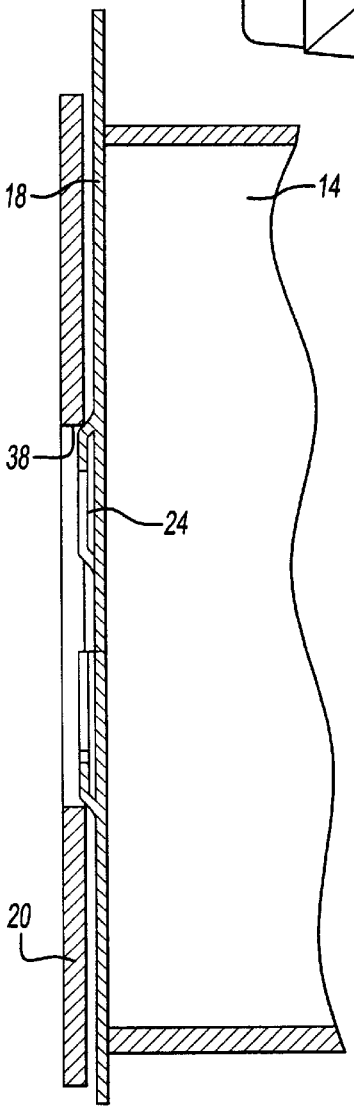
FIG. 2 is a cross-sectional view of the faceplate and fascia.
Figure 3:
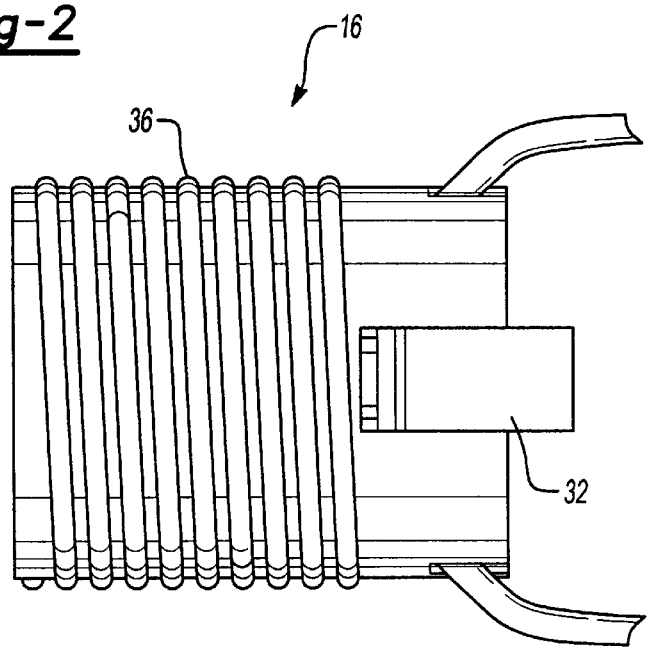
FIG. 3 is a side view of the light socket.

Referring first to FIG. 1, there is shown a fully assembled light bar 10 adapted for mounting to a wall of a bathroom preferably over a vanity area for illumination. Typically, the light bar 10 will be supplied electrical power through a wire running through the wall and controlled by a light switch. In a preferred embodiment, the light bar 10 will have a plurality of light bulbs 12 depending upon the size of the vanity area.

The light bar 10 includes an electrical housing 14 which may be mounted into or against the wall above the vanity. The electrical wires are fed through the housing 14 for connection to individual light sockets 16 which receive the light bulbs 12. The light sockets 16 are secured to a faceplate 18 which is mounted to the housing 14 in order to enclose the housing 14. The light sockets 16 are secured to the faceplate 18 in accordance with the present invention. In order to improve the aesthetic appearance of the light bar 10, a fascia 20 may be mounted against the faceplate 18 and a decorative sleeve 22 may be coaxially mounted to conceal the socket 16. The fascia 20 and decorative sleeve 22 may be composed of any number of decorative finishes such as polished brass or chrome, wood or a mirrored surface and are interchangeable on the light bar 10 in order to provide the customer a wide variety of decorative choices while minimizing inventory requirements.

Figure 4:
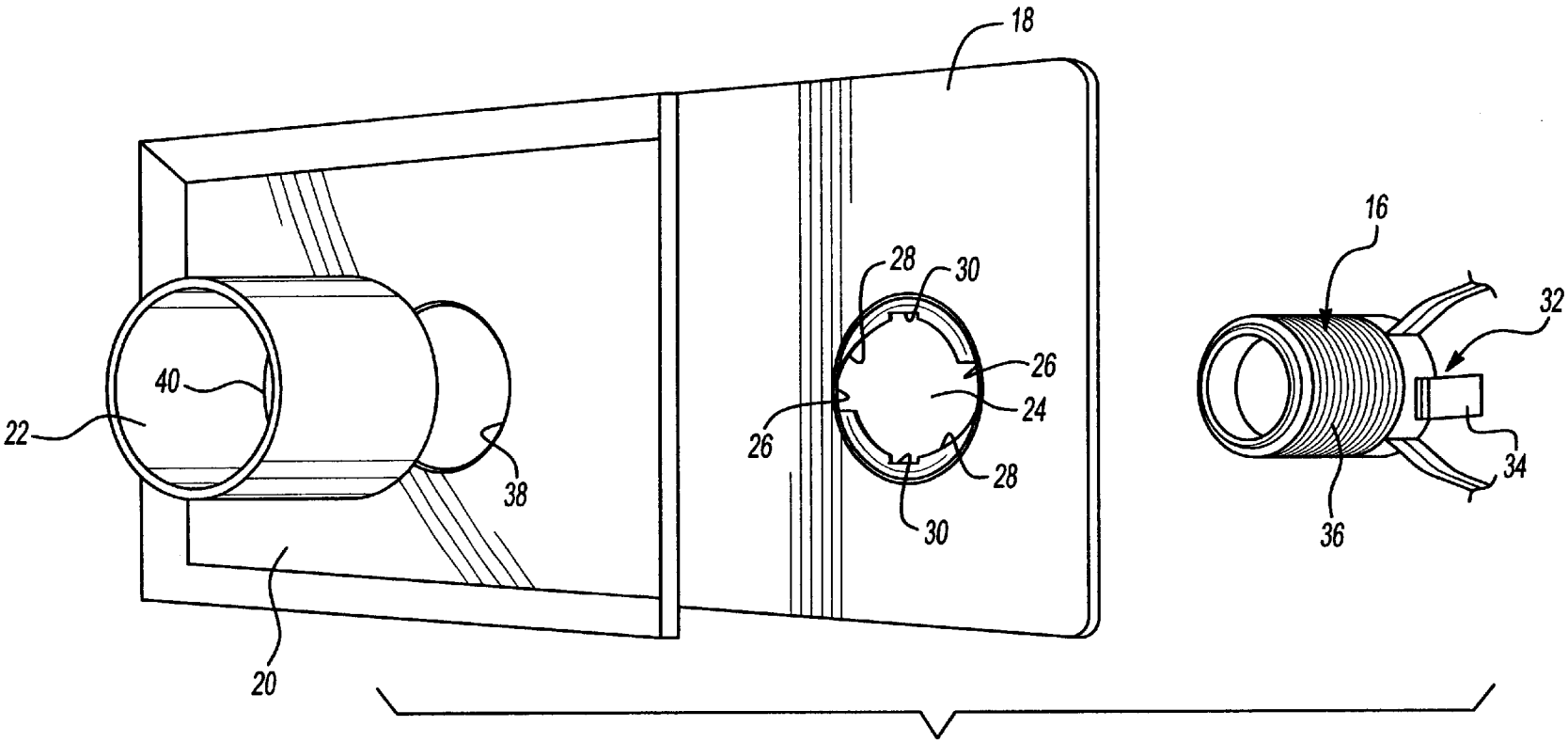
FIG. 4 is an exploded perspective view of the light assembly.
Figure 5:
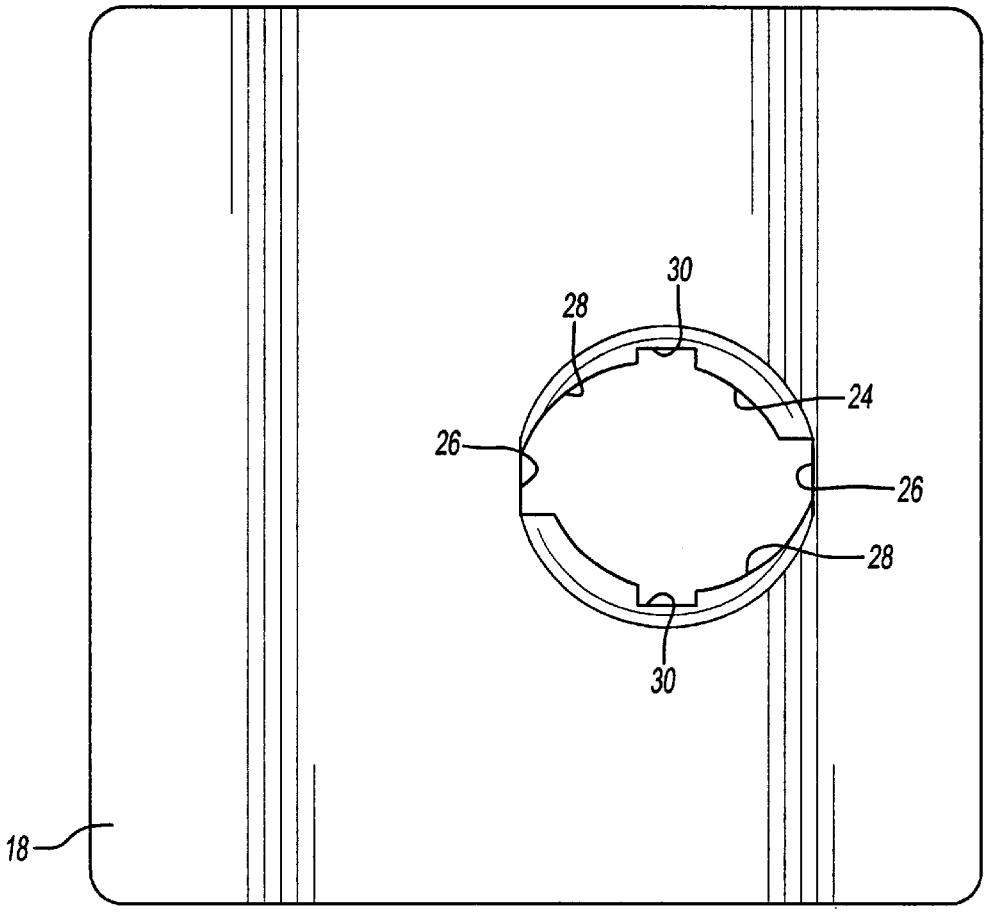
FIG. 5 is a front elevational view of the faceplate for receiving the light socket.

The faceplate 18 includes a specially configured aperture 24 for detachably receiving the socket 16 in accordance with the present invention. As best shown in FIGS. 4 and 5, the aperture 24 has a substantially helical configuration which gradually reduces the diameter of the aperture 24 over the circumference of the aperture 24. In a preferred embodiment, the aperture 24 includes opposed insertion slots 26 forming the largest diameter, a helical edge 28 which gradually reduces the diameter, and a retaining notch 30 formed in the helical edge 28.

The aperture receives the light socket 16, and in particular, a spring clip 32 mounted to the light socket 16. The spring clip 32 preferably has a pair of biasing arms 34 extending laterally outwardly. In addition, the light socket 16 has an outer cylindrical surface which is formed with threads 36.

Figure 6:
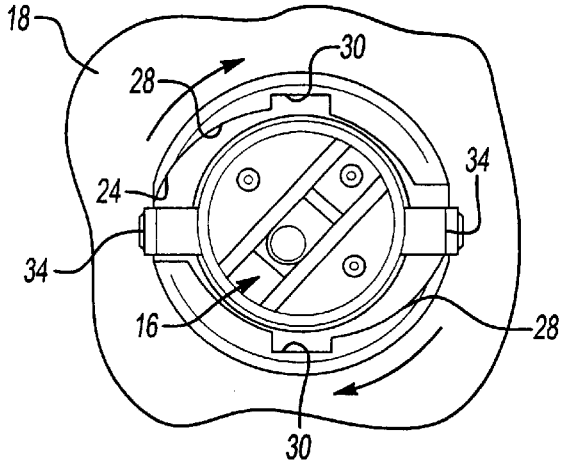
FIG. 6 is a partial front elevational view showing the light socket inserted into the faceplate aperture in a first position.
Figure 7:
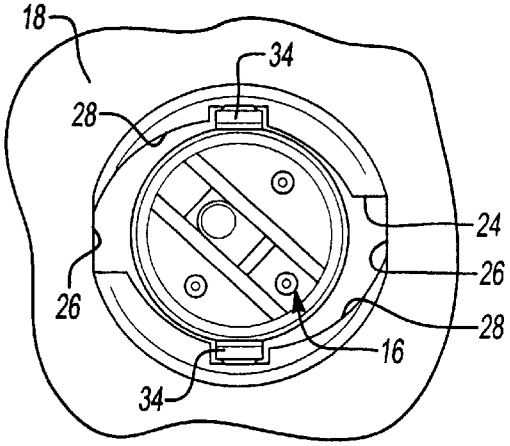
FIG. 7 is a partial front elevational view showing the socket in the fully assembled position.

Mounting of the light socket 16 to the faceplate 18 is accomplished through cooperation of the spring clip 32 with the peripheral edge of the aperture 24. The light socket 15 is inserted through the rear of the faceplate 18 such that the biasing arms 34 are positioned within the insertion slots 26 (FIG. 6). Thereafter, rotation of the socket 16 will move the biasing arms 34 along the helical edge 28 gradually compressing the spring clip 32. Once the spring clip 32 reaches the retaining notch 30 (FIG. 7) further rotation of the socket 16 is prevented and the socket 16 will be maintained in the faceplate 18 with the threaded cylindrical portion 36 positioned out in front of the faceplate 18. Removal of the socket 16 requires compression of the spring clip 32 and rotation out of the retaining notch 30.

If desired, a decorative fascia 20 and sleeve 22 may be attached to improve the aesthetic appearance of the light bar 10. The fascia 20 will include aperture 38 corresponding to the sockets 16 through which the socket 16 is inserted. The fascia 20 is maintained against the faceplate 18 by the sleeve 22 which is threadably mounted to the socket 16. The sleeve 22 includes an inner flange 40 which threadably engages the threads 36 of the socket 16. The sleeve 22 is threaded onto the socket 16 until the fascia 20 is positionally captured between the sleeve 22 and the faceplate 20.

The foregoing detailed description has been given for clearness of understanding only and no unnecessary limitations should be understood therefrom as some modifications will be obvious to those skilled in the art.

What is claimed is:

1. An electrical light assembly adapted to be mounted to a wall, said light assembly comprising:

a light socket having a substantially cylindrical body and including a spring clip having a pair of spring arms disposed outwardly of said cylindrical body with an externally threaded surface and biased radially outwardly;

a faceplate having an aperture for receiving said light socket, said aperture having a peripheral edge with retaining notches at a predetermined position along said peripheral edge for fixedly retaining said spring arms, said spring clip lockingly engaging said retaining notches of said peripheral edge to position said light socket within said aperture substantially perpendicular to said faceplate;

a sleeve member threadably attached to said light socket for substantially concealing said socket.

2. The light assembly as defined in claim 1 wherein said peripheral edge of said aperture includes a helical portion having a reducing diameter thereof between a first larger diameter and a second reduced diameter.

3. The light assembly as defined in claim 2 wherein said peripheral edge of said aperture includes diametrically opposed insertion slots of said first larger diameter.

4. The light assembly as defined in claim 3 wherein said retaining notches of said peripheral edge of said aperture are diametrically opposed at a predetermined position along said helical edge portion for fixedly retaining said spring clip of said light socket.

5. The light assembly as defined in claim 4 wherein said spring arms are disposed diametrically outwardly of said cylindrical body for selective engagement with said peripheral edge of said aperture upon insertion of said light socket into said aperture of said faceplate, said light socket selectively rotatable between a first insertion position with said spring arms disposed in said insertion slots and a second locked position with said spring arms disposed in said retaining notches, said helical edge biasingly compressing said spring arms upon rotation of said light socket between said first and second positions.

6. The light assembly as defined in claim 1 and further comprising a fascia panel, said fascia panel including an aperture for receiving said light socket, said fascia panel maintained in flush engagement with said face plate by said sleeve member threadably mounted to said light socket.

7. The light assembly as defined in claim 1 wherein said faceplate is mounted to a housing secured to the wall, said housing retaining electrical wires in communication with a light switch.

8. An electrical light assembly adapted to be mounted to a wall, said light assembly comprising:

a light socket having a substantially cylindrical body and including a spring clip with spring diametrically opposed spring arms extending radially outwardly from said socket body, said spring arms biased radially outwardly from said socket body; with an externally threaded surface and a faceplate having an aperture for receiving said light socket, said aperture having a peripheral edge with diametrically opposed insertion slots, a helical portion having a reducing diameter of said aperture and diametrically opposed retaining notches at a predetermined position along said helical edge portion, said light socket selectively rotatable between a first insertion position with said spring arms biased radially inwardly for insertion in said insertion slots and a second locked position with said spring arms disposed in said retaining notches, said helical edge biasingly compressing said spring arms upon rotation of said light socket between said first and second positions; and a sleeve member threadably attached to said light socket for substantially concealing said socket.

9. The light assembly as defined in claim 8 and further comprising a fascia panel, said fascia panel including an aperture for receiving said light socket, said fascia panel maintained in flush engagement with said faceplate by said sleeve member threadably mounted to said light socket.

10. An electrical light assembly adapted to be mounted to a wall, said light assembly comprising:

a light socket having a substantially cylindrical body and including a spring clip, said cylindrical body having an outer threaded surface;

a faceplate having an aperture for receiving said light socket, said aperture having a peripheral edge, said spring clip lockingly engaging said peripheral edge to position said light socket within said aperture substantially perpendicular to said faceplate;

a sleeve member threadably attached to said light socket for substantially concealing said socket; and a fascia panel having an aperture for receiving said light socket, said fascia panel maintained in flush engagement with said face plate by said sleeve member threadably mounted to said light socket.

11. The light assembly as defined in claim 10 wherein said peripheral edge of said aperture includes a helical portion having a reducing diameter thereof between a first larger diameter and a second reduced diameter.

12. The light assembly as defined in claim 11 wherein said peripheral edge of said aperture includes diametrically opposed insertion slots of said first larger diameter.

13. The light assembly as defined in claim 12 wherein said peripheral edge of said aperture includes diametrically opposed retaining notches at a predetermined position along said helical edge portion for fixedly retaining said spring clip of said light socket.

14. The light assembly as defined in claim 13 wherein said spring clip of said light socket includes a pair of spring arms disposed diametrically outwardly of said cylindrical body for selective engagement with said peripheral edge of said aperture upon insertion of said light socket into said aperture of said faceplate, said light socket selectively rotatable between a first insertion position with said spring arms disposed in said insertion slots and a second locked position with said spring arms disposed in said retaining notches, said helical edge biasingly compressing said spring arms upon rotation of said light socket between said first and second positions.

* * * * *